US006344788B1

(12) United States Patent
Forys et al.

(10) Patent No.: US 6,344,788 B1
(45) Date of Patent: Feb. 5, 2002

(54) PYROTECHNICALLY OPERATED ELECTRICAL CONTACTOR

(75) Inventors: Christian J Forys, Auvers-sur-Oise; Bernard J Lallemant, Flims-sur-Seine, both of (FR)

(73) Assignee: Pyroalliance, Les Mureaux (FR)

( * ) Notice: Subject to any disclaimer, the term of this patent is extended or adjusted under 35 U.S.C. 154(b) by 0 days.

(21) Appl. No.: 09/455,452

(22) Filed: Dec. 6, 1999

(30) Foreign Application Priority Data

Dec. 30, 1998 (FR) ..... 98 16613

(51) Int. Cl.[7] ..... H01H 37/76; H01H 85/55

(52) U.S. Cl. ..... 337/401; 337/405; 337/182; 337/185; 180/282; 180/283; 280/734; 361/45

(58) Field of Search ..... 337/301, 571, 337/401, 404–409, 182, 185; 307/119, 9.1–10.8; 180/271, 274, 279, 281–283; 200/61.08; 361/115; 280/734, 735

(56) References Cited

U.S. PATENT DOCUMENTS

| | | | | | |
|---|---|---|---|---|---|
| 2,999,912 | A | | 9/1961 | Kincaid et al. | |
| 3,570,403 | A | * | 3/1971 | Hawley et al. | 102/28 |
| 3,793,501 | A | * | 2/1974 | Stonestrom | 200/61.08 |
| 3,803,374 | A | * | 4/1974 | Delgrende et al. | 200/61.08 |
| 3,885,223 | A | | 5/1975 | Green | |
| 4,128,745 | A | * | 12/1978 | Marsilio et al. | 200/16 C |
| 4,186,288 | A | * | 1/1980 | Overton et al. | 200/164 R |
| 4,339,638 | A | * | 7/1982 | Lascelles et al. | 200/52 R |
| 4,354,432 | A | * | 10/1982 | Cannavo' et al. | 102/202.7 |
| 4,490,707 | A | | 12/1984 | O'Leary | |
| 4,816,626 | A | * | 3/1989 | Valenzona et al. | 200/16 |
| 5,360,999 | A | * | 11/1994 | Upshaw et al. | 307/112 |
| 5,783,987 | A | * | 7/1998 | Kern et al. | 37/76 |
| 5,808,253 | A | * | 9/1998 | Hatakeyama | 200/61.08 |
| 5,877,563 | A | * | 3/1999 | Krappel et al. | 307/10.1 |
| 6,144,111 | A | * | 11/2000 | Krappel et al. | 307/10.1 |

FOREIGN PATENT DOCUMENTS

| | | | | | |
|---|---|---|---|---|---|
| DE | 19712387 | A1 | | 10/1997 | |
| EP | 0665 566 | A1 | | 8/1995 | |
| JP | 11-232978 | A | * | 8/1999 | H01H/39/00 |
| JP | 11-232979 | A | * | 8/1999 | H01H/39/00 |
| WO | WO 97/37873 | | | 10/1997 | |

* cited by examiner

*Primary Examiner*—Leo P. Picard
*Assistant Examiner*—Anatoly Vortman

(57) ABSTRACT

The present invention relates to electrical contactors used in electric motors comprising batteries.

The present invention relates more specifically to an electrical contactor (1) for a battery, consisting of a hollow body (2) defining an upstream part (11) in which a pyrotechnic initiation device (3) is located and a downstream part in which a piston (4) is housed. Since the downstream part has three conducting studs (5, 6, 7), the main characteristic of the contactor (1) according to the invention is that it makes it possible, when the piston (4) moves due to the effect of the combustion gases, to pass instantaneously from a position corresponding to the electrical connection of the first two studs (5, 6) to a position corresponding to the electrical connection of the second stud (6) to the third stud (7).

9 Claims, 2 Drawing Sheets

PYROTECHNICALLY OPERATED ELECTRICAL CONTACTOR

BACKGROUND OF THE INVENTION

The technical field of the invention is that of electrical contactors, especially those used in electric motors comprising batteries and serving to propel motor vehicles or spacecraft such as satellites.

The present invention relates more especially to a pyrotechnically operated electrical contactor making it possible, in the event of an anomaly, to open the electrical circuit upstream of the defective battery element and to close a shunt circuit, so as to isolate the defective battery element while still ensuring continuity of the electrical circuit. This type of contactor is used to prevent an electric motor from automatically breaking down in the event of a malfunction of one of its battery elements.

Several kinds of pyrotechnically operated electrical contactors have already formed the subject of patents.

A first type of contactor is described in U.S. Pat. No. 3,885,223. This is a pyrotechnically operated electrical contactor provided in one of its chambers with a tube having a flattened cross section. As long as this contactor has not yet operated, it closes a circuit by means of the external surface of the casing of the tube, at the two points on the flattened closed cross section which are furthest apart. In the operating phase, the combustion gases enter the tube and generate a pressure such that the tube deforms and assumes a circular cross section.

Thus, in the direction in which the tube was radially contracted, the initial electrical contacts were broken and, on the other hand, in the direction in which it was radially expanded, two new, diametrically opposed, electrical contacts were established.

The electrical contactor described in European Patent EP 0,665,566 is also pyrotechnically operated. It employs a gas generator whose function is to move a conducting piece in contact with another conducting piece so as to separate them in order to interrupt the electric current.

Electrical contactors that can be used in the field of application of electric motors provided with batteries, and that have the dual function of opening an electrical circuit and of closing another one almost simultaneously, must have two characteristics sought after by those skilled in the art: they must, on the one hand, act in an extremely short time and, on the other hand, they must be non-dissipative, that is to say the resistance of the active circuit, and particularly the resistance of the contacts, must be reduced to the minimum in order to avoid, as far as possible, energy dissipation by the Joule effect, whereas the resistance of the unactivated circuit is infinite.

SUMMARY OF THE INVENTION

The contactor according to the invention meets this dual requirement.

The subject of the present invention relates to an electrical contactor, especially for a battery, having of a hollow body defining an upstream part in which a pyrotechnic initiation device is located and a downstream part in which a piston is housed, characterized in that:

a—the downstream part has at least three electrical contact points;

b—the piston, having a conducting part initially connecting the first electrical contact point to the second electrical contact point, can move due to the effect of the pressure generated by the gases arising from the combustion of the pyrotechnic initiation device in order to connect at least one other electrical contact point.

According to a preferred embodiment of the invention, the downstream part has three electrical contact points and the piston, whose conducting part connects the first electrical contact point to the second electrical contact point, can move due to the effect of the pressure generated by the gases arising from the combustion of the pyrotechnic initiation device in order to connect the second electrical contact point to the third electrical contact point. Preferably, apart from its conducting part, the piston is made entirely from an insulating solid material.

Advantageously, the hollow body is an elongate tube. Preferably, the electrical contact points are located in the side wall of the downstream part of the tube.

Advantageously, the electrical contact points comprise a plurality of conducting studs. Preferably, the three studs are fixed, aligned and uniformly spaced and the piston undergoes a translational movement in the downstream part when it is subjected to the pressure of the combustion gases arising from the pyrotechnic initiation device.

Advantageously, the conducting part of the piston includes of a plate which remains constantly in contact with at least two studs during its movement and which, at a given instant during the said movement, is momentarily connected to the three studs.

Thus, the opening of the first circuit takes place while the electric current is already flowing in the second circuit, making it possible to avoid, for a short time, the simultaneous opening of the two electrical circuits.

This is because momentarily interrupting the electric current could cause undesirable spurious phenomena to occur such as, for example, the functional members supplied being inopportunely reset to zero.

Preferably, the downstream part of the tube has a conical free end allowing the piston set into motion by the combustion gases to terminate its travel by being jammed in the said conical end. In this way, the piston remains fixed in this position without any risk of it returning to the downstream part.

Advantageously, the pyrotechnic initiation device is screwed into the upstream part of the elongate tube.

Preferably, each conducting stud is inserted into an insulating structure fitted into the wall of the downstream part of the tube.

Preferably, each conducting stud is inserted into an insulating hollow screw which is screwed into the wall of the downstream part of the elongate tube.

Advantageously, each stud and the plate are made of a copper-based material.

According to a preferred embodiment of the invention, the hollow body is made of an aluminium-based light alloy.

Preferably, the pyrotechnic initiation device is constructed from a hot-wire initiator of the type of those used in motor-vehicle mass production. Advantageously, the pyrotechnic charge of the said initiator consists of an oxidation-reduction ignition composition.

The contactor according to the invention has the advantage of being lightweight, simple in design and small in size.

The pieces involved in the operation of the mechanism of the contactor are subjected to moderate frictional forces. Thus, their movement requires only a small amount of pyrotechnic material in the initiator and their mechanical strength may be provided by making them from a light material.

In addition, when the contactor is in the switching phase, it ensures at all times that electric current is flowing in one or other of the two electrical circuits, thus avoiding a complete and momentary cut-off which could result in undesirable spurious phenomena with unpredictable consequences for the circuit.

Finally, another advantage afforded by the invention is the non-dissipative character of the contactor, resulting in there being no energy dissipation by the Joule effect.

BRIEF DESCRIPTION OF THE DRAWINGS

A detailed description of a preferred embodiment of an electrical contactor according to the invention is given below with reference to FIGS. 1, 2 and 3.

DETAILED DESCRIPTION OF PREFERRED EMBODIMENT

Figure 1:
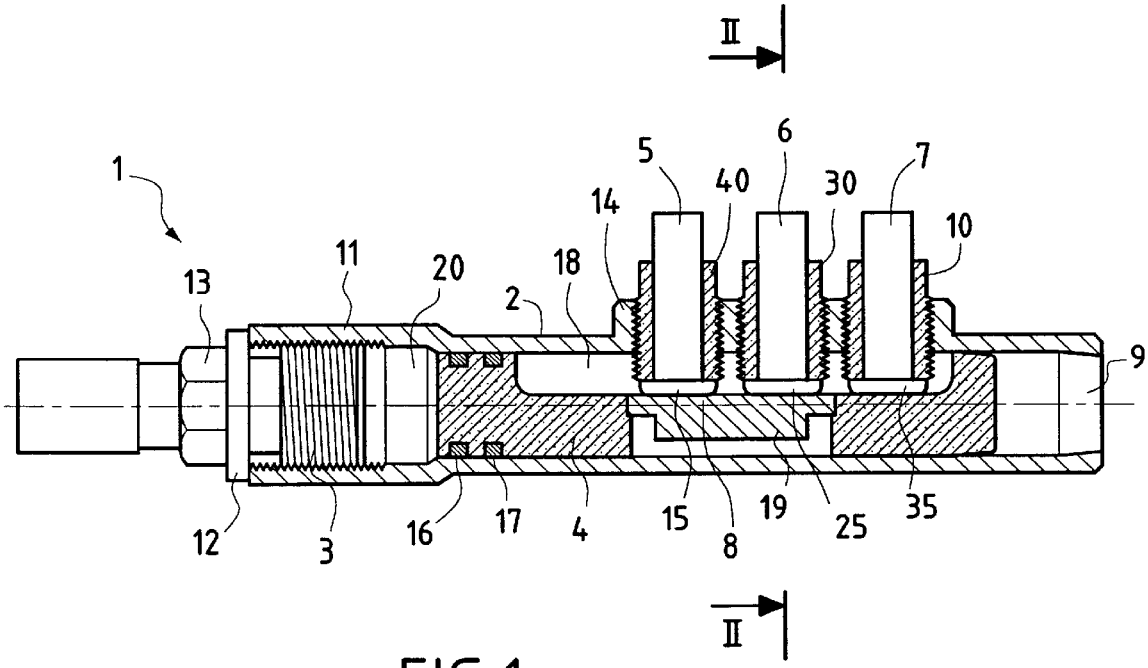
FIG. 1 is a longitudinal section of a contactor according to the invention that has not yet operated.

Referring to FIG. 1, an electrical contactor 1 according to the invention consists of a hollow body 2 made of an aluminium-based light alloy and having an approximately cylindrical downstream part extended by a widened cylindrical upstream part 11, the two parts being connected together with one in the extension of the other.

The widened cylindrical part 11 has a threaded bore and, at one of its ends, a circular face 12 having an opening at its center. The pyrotechnic initiation device 3 has the shape of a screw with a widened hexagonal head 13 and a threaded cylindrical body and is constructed from a hot-wire initiator normally used in motor-vehicle mass production and comprising a gas-generating pyrotechnic charge, for example, an oxidation-reduction ignition composition. The pyrotechnic initiation device 3 is screwed on until the head 3 butts against the circular face 12. A circular seal jammed between the body of the pyrotechnic initiation device 3 and the internal wall of the upstream part of the hollow body 2 ensures that the said upstream part 11 is properly sealed with respect to the ambient environment.

The approximately cylindrical downstream part has a projecting flat part 14 of rectangular shape, which acts as a platform and has three identical internal threads aligned along the axis of the hollow body 2 and uniformly spaced apart, the said internal threads connecting the downstream part of the hollow body 2 with the outside of the contactor 1.

Three insulating hollow screws 10, 30, 40 threaded on their external cylindrical surface are screwed into the internal threads and are intended to accommodate and firmly retain conducting cylindrical studs 5, 6, 7, each terminating in a widened cylindrical flat head 15, 25, 35 of diameter greater than the diameter of the bores of the said hollow screws 10, 30, 40.

The downstream part of the hollow body 2, which defines an approximately cylindrical space, contains a monobloc piston 4 having two cylindrical outermost parts of diameter slightly less than that of the cylindrical space and one of which, the one closer to the pyrotechnic initiation device 3, has on its periphery and jammed against the internal wall of the downstream part of the hollow body 2 two parallel seals 16, 17, and an intermediate part of uniform, small cross section in the form of a circular segment, partially occupying the downstream part and therefore leaving a free space 18 in the said downstream part. The piston 4 is made of an insulating material.

Figure 2:
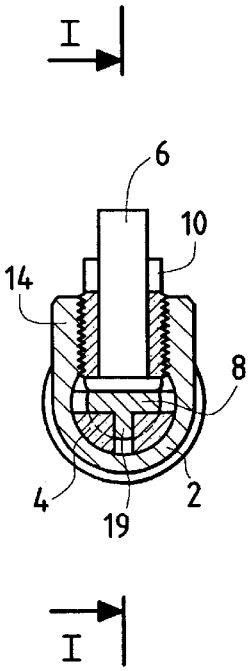
FIG. 2 is a cross section on the plane II—II of a contactor according to the invention.

Referring to FIGS. 1 and 2, the intermediate part of the piston 4 in its central downstream part has a surface recess at the bottom of which a straight groove is cut out, which groove lies along the axis of the downstream part and in which groove a monobloc conducting piece slides. The said piece makes it possible to make out a parallelepipedal conducting plate 8 of rectangular shape and a conducting base 19. The said base 19, which is also parallelepipedal and of rectangular shape, has a length less than that of the plate 8 and lies in the central region of the said plate 8 along its major axis, perpendicular to the latter. In other words, over the entire length of the base 19, the monobloc conducting piece has a T-shaped cross section and, on either side of this length, the cross section of the said monobloc piece becomes that of the plate 8 which is rectangular. The monobloc conducting piece is placed in the intermediate part of the piston 4 so that the plate 8 occupies the recess and the base 9 lies in the groove.

The height of the plate 8 corresponds to the depth of the recess, thus ensuring continuity between the surface of the intermediate part of the piston 4 and that of the plate 8. Since the height of the base 19 is less than the depth of the groove, the width of the plate 8 is less than the diameter of the downstream part of the hollow body 2 and the plate 8 butts, on either side of its length, against the intermediate part of the piston 4, the monobloc conducting piece is insulated from the hollow body 2.

The various elements involved in the downstream part are arranged so that the cylindrical flat heads 15, 25, 35 of each stud 5, 6, 7 emerge from the bores of the hollow screws 10, 30, 40 into the open space 18 in the downstream part and come into contact either with the intermediate part of the piston 4 or with the conducting plate 8 which are in continuity one with respect to the other.

The conducting studs 5, 6, 7 and the conducting plate are made of protected copper.

The free end 9 of the downstream part has a convergent conical shape, resulting in a gradual narrowing of the diameter towards the exit of the said downstream part.

The two ends of the piston 4 each have a plane circular face and the length of the said piston 4 is less than that of the downstream part. It is separated from the pyrotechnic initiation device 3 by an open space 20 which serves as a gas expansion chamber when the initiation device 3 is triggered.

The operating principle of the contactor 1 according to the invention follows the following steps.

Figure 3:
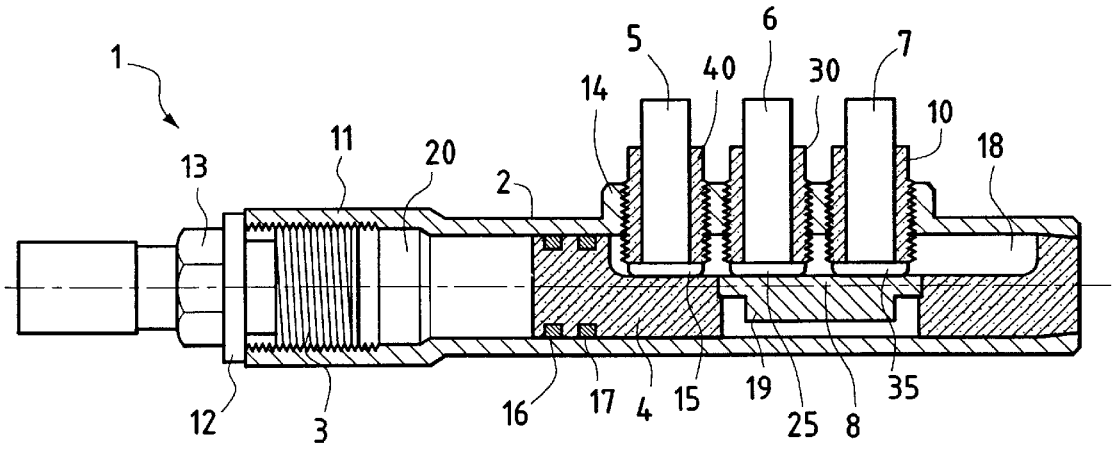
FIG. 3 is a longitudinal section of the contactor which is shown in FIG. 1 and which has carried out the switching operation.

A sensor, which is external to the contactor 1, detects an abnormal voltage in the circuit, that is to say a voltage outside the limits of the range of values for which it has been programmed, and sends an electrical pulse to the pyrotechnic initiation device 3, causing it to ignite. The combustion gases expand into the open space 20, provided for this purpose just upstream of the piston 4, and when the forces on the piston 4 due to the gas pressure are high enough and exceed the frictional resistive forces, the piston 4 is set into motion and slides into the downstream part of the hollow body 2. Until the piston 4 has started its travel, the conducting plate 8 is in contact with the first two conducting studs 5, 6 at their cylindrical flat heads 15, 25, closing the charging/discharging circuit of the battery. Once the piston 4 has started to move into the downstream part, the conducting plate 8 firstly comes into contact with the flat cylindrical head 35 of the third stud 7 while the said plate is still in contact with the first stud 5, and then, secondly, continues its travel while maintaining contact between the second stud 6 and the third stud 7, but being disconnected from the first stud 5. Referring to FIG. 3, the piston 4 completes its movement by bonding in the conical end 9 of the downstream part without emerging therefrom, in a position corresponding to the disconnection from the first stud 5 and to the connection of the second stud 6 to the third stud 7. In this way, the contactor 1 according to the invention offers a transient phase during which the two circuits are momentarily closed before the first circuit is opened. Thus, the phase of connection between the second stud 6 and the third stud 7 is not preceded by a prior phase of complete and momentary cut-off of the electric current so as to avoid certain undesirable spurious phenomena.

During the operating phase of the contactor 1 corresponding to the movement of the piston 4, the heads 15, 25, 35 of the three conducting studs 5, 6, 7 are aligned and at all times in contact with the intermediate part of the piston 4, either at the conducting plate 8 or at the piston 4 itself. It should be pointed out that such a device operates in less than five milliseconds from the time of application of the rated firing current.

What is claimed is:

1. An electrical contactor, comprising:

a hollow body defining an upstream part in which a pyrotechnic initiation device is located; and a downstream part in which a piston is housed, the downstream part having three electrical contact points that include three cylindrical conducting studs which are parallel, the piston having a conducting part initially connecting the first stud to the second stud and being movable due to the pressure generated by the gases arising from the combustion of the pyrotechnic initiation device in order to connect the second stud to the third stud, wherein:

the studs are exclusively made of conducting material, the piston is movable along a direction which is perpendicular to an axis of the studs, and the conducting part of the piston remains constantly in contact with at least two studs during its movement and, at a given instant during the movement, is momentarily connected to the three studs.

2. The electrical contactor according to claim 1, wherein the hollow body is an elongated tube.

3. The electrical contactor according to claim 2, wherein the conducting studs are located in a side wall portion of the downstream part of the tube.

4. The electrical contactor according to claim 1, wherein the conducting part of the piston comprises a plate.

5. The electrical contactor according to claim 4, wherein each of the plurality of conducting studs and the plate are made of a copper-based material.

6. The electrical contactor according to claim 1, wherein the downstream part of the hollow body has a conical free end allowing the piston set into motion by the combustion gases to terminate its travel by being jammed in the conical end.

7. The electrical contactor according to claim 1, wherein each of the plurality of conducting studs are inserted into an insulating structure fitted into the wall of the downstream part of the hollow body.

8. The electrical contactor according to claim 1, wherein the hollow body is made of an aluminum-based light alloy.

9. The electrical contactor according to claim 1, wherein the pyrotechnic initiation device is constructed from a hot-wire initiator of the type of those used in motor-vehicle mass production.

* * * * *